US007185394B2

(12) United States Patent
Hafling et al.

(10) Patent No.: US 7,185,394 B2
(45) **Date of Patent: *Mar. 6, 2007**

(54) DIRT CUP ASSEMBLY WITH ATTACHABLE AND DETACHABLE EXTERNAL FILTER HOLDER

(75) Inventors: Danielle M. Hafling, Lancaster, KY (US); Joel E. Hitzelberger, Danville, KY (US); Alan T. Pullins, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 426 days.

This patent is subject to a terminal disclaimer.

(21) Appl. No.: 10/631,365

(22) Filed: Jul. 31, 2003

(65) Prior Publication Data

US 2004/0088819 A1 May 13, 2004

Related U.S. Application Data

(60) Provisional application No. 60/424,425, filed on Nov. 7, 2002.

(51) Int. Cl.
*A47L 9/10* (2006.01)
*A47L 9/12* (2006.01)

(52) U.S. Cl. ..... 15/347; 15/351; 55/429; 55/DIG. 3

(58) Field of Classification Search ..... 15/327.1, 15/327.2, 327.7, 347, 350–352; 55/429, 55/493, DIG. 3, 471, 472
See application file for complete search history.

(56) References Cited

U.S. PATENT DOCUMENTS

| | | | | |
|---|---|---|---|---|
| 2,794,513 | A * | 6/1957 | Hultberg et al. | 55/366 |
| 4,426,211 | A | 1/1984 | Ataka et al. | |
| 4,545,794 | A * | 10/1985 | Himukai | 55/362 |
| 5,230,722 | A | 7/1993 | Yonkers | |
| 5,829,090 | A | 11/1998 | Melito et al. | |
| 5,840,103 | A * | 11/1998 | Dyson | 96/61 |
| 5,961,676 | A * | 10/1999 | King et al. | 55/334 |
| 5,961,677 | A * | 10/1999 | Scott | 55/385.1 |
| 6,035,486 | A * | 3/2000 | McCormick | 15/352 |
| 6,311,366 | B1 | 11/2001 | Sepke et al. | |
| 6,341,404 | B1 | 1/2002 | Salo et al. | |
| 6,532,620 | B2 | 3/2003 | Oh | |
| 2002/0073663 | A1 | 6/2002 | Sepke et al. | |
| 2004/0074042 | A1 * | 4/2004 | Overvaag | 15/347 |

FOREIGN PATENT DOCUMENTS

| | | | |
|---|---|---|---|
| DE | 4240172 | * | 6/1994 |
| EP | 1033102 | * | 3/2000 |
| JP | 56-136642 | | 10/1981 |
| JP | 56-136650 | | 10/1981 |

* cited by examiner

*Primary Examiner*—Terrence R. Till
(74) *Attorney, Agent, or Firm*—King & Schickli, PLLC

(57) ABSTRACT

A dirt cup for a vacuum cleaner includes a housing defining a dirt collection chamber, an inlet and an outlet in the housing in fluid communication with the dirt collection chamber and a selectively attachable and detachable filter holder on the housing external to the dirt collection chamber and downstream from the outlet. A vacuum cleaner incorporating the dirt cup is also provided.

18 Claims, 5 Drawing Sheets

DIRT CUP ASSEMBLY WITH ATTACHABLE AND DETACHABLE EXTERNAL FILTER HOLDER

This application claims the benefit of U.S. Provisional Patent Application Ser. No. 60/424,425, filed Nov. 7, 2002.

TECHNICAL FIELD

The present invention relates generally to the floor care equipment field and, more particularly, to a novel dirt cup and external, selectively attachable and detachable removable filter arrangement as well as to a vacuum cleaner incorporating such an arrangement.

BACKGROUND OF THE INVENTION

Bagless vacuum cleaner technology has long been known in the art. Japanese Patent Applications 56-136642 and 56-136650 both published in 1981 disclose an upright vacuum cleaner with a dust collection chamber that removably connects to an opening in the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt cup for a bagless vacuum cleaner that includes a separate, attachable and detachable filter holder. The invention may be utilized on upright, canister and/or hand-held vacuum cleaners.

SUMMARY OF THE INVENTION

In accordance with the purposes of the present invention as described herein, a novel dirt cup is provided for floor care cleaning equipment such as an upright, canister or hand-held vacuum cleaner. The dirt cup includes a housing defining a dirt collection chamber. An inlet and outlet are provided in the housing in fluid communication with that dirt collection chamber. Further, the dirt cup includes an attachable/detachable filter holder on the housing external to the dirt collection chamber and downstream from the outlet.

The dirt cup may include a prefilter held on the housing across the outlet. That prefilter may take the form of a screen. Additionally, the dirt cup includes a filter in the attachable/detachable filter holder. The filter may take the form of a filter cartridge including a support and a pleated filter media such as of a type known in the art to be useful for this purpose.

The housing of the dirt cup includes a top wall, a first sidewall and a bottom wall. In one possible embodiment the inlet and outlet are both provided in the first sidewall. In one possible embodiment the housing includes a closed top and the bottom wall is removable to allow emptying of the dirt collection chamber. That bottom wall may be connected by a hinge to a second sidewall if desired. A first latch carried on the housing secures the bottom wall in the closed position. A second latch carried on the housing secures the dirt cup to the main housing of the vacuum cleaner.

In accordance with yet another aspect of the present invention, a vacuum cleaner is provided. That vacuum cleaner incorporates the dirt cup of the present invention.

In the following description there is shown and described a preferred embodiment of the invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
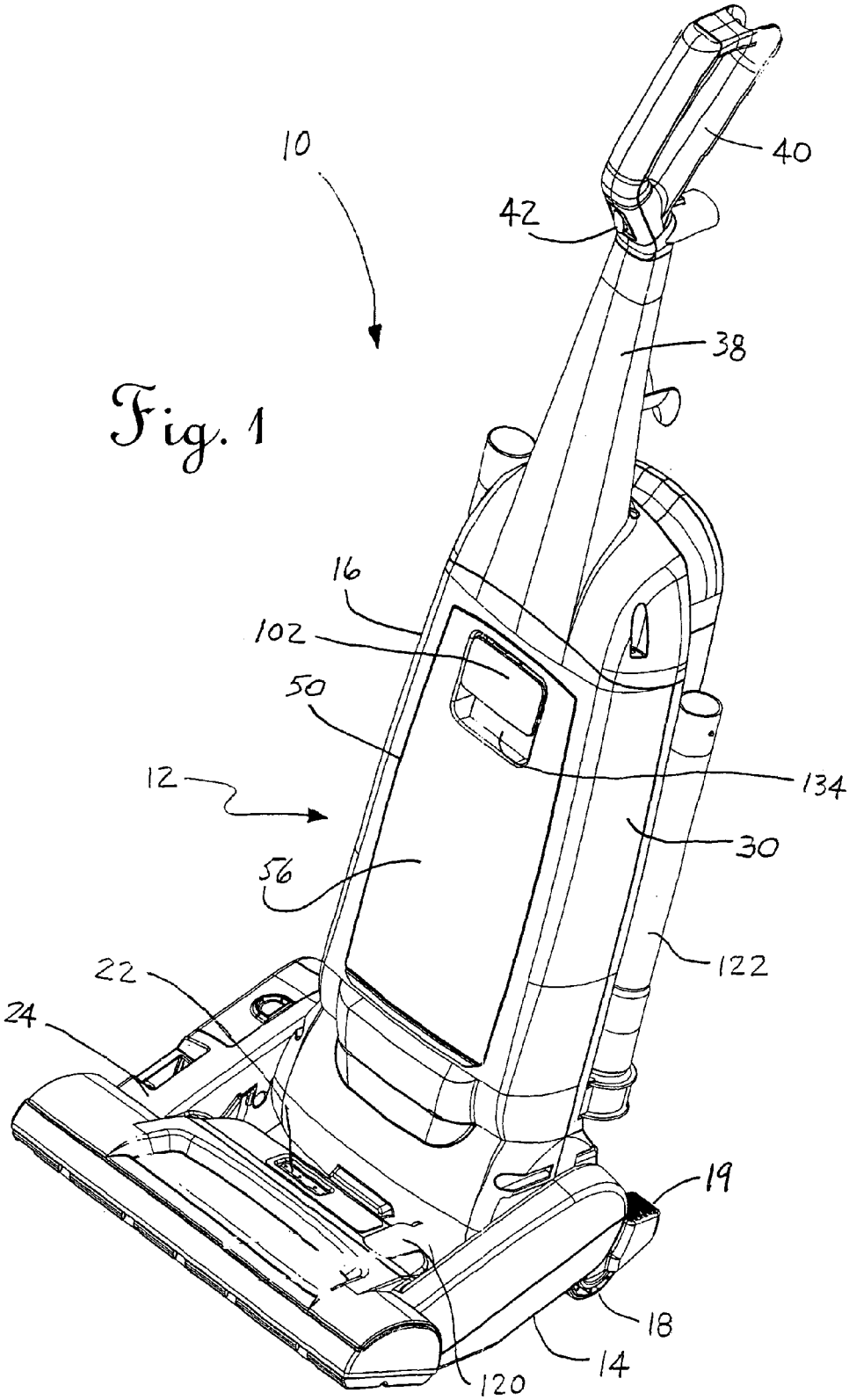
FIG. 1 is a perspective view of an upright vacuum cleaner incorporating the novel dirt cup of the present invention.
Figure 2:
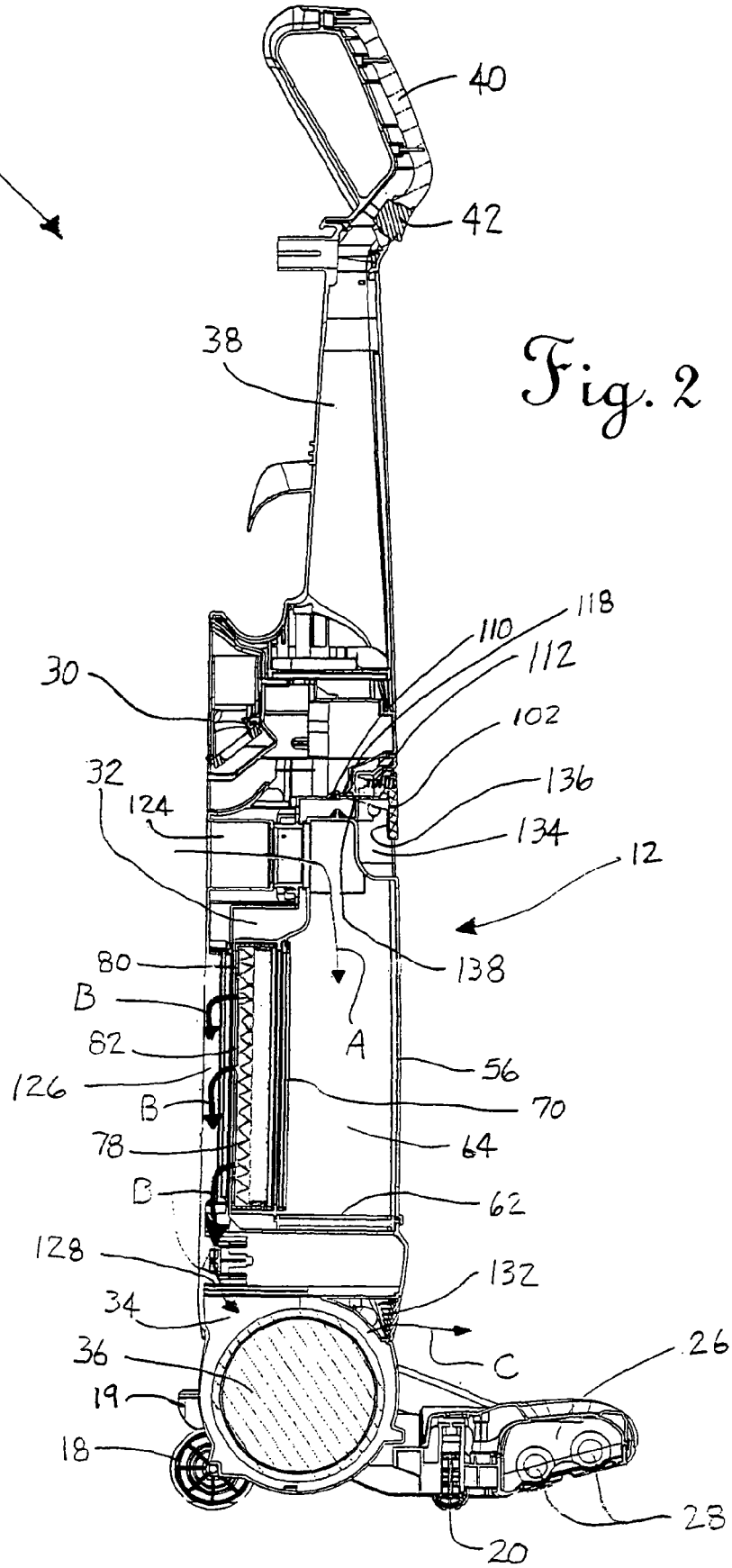
FIG. 2 is a partially schematical and partially cross-sectional view of the vacuum cleaner illustrated in FIG. 1 clearly illustrating the mounting of the dirt cup in the canister housing of the vacuum cleaner.

Reference is now made to FIG. 1 illustrating an upright vacuum cleaner 10 incorporating the dirt cup 12 of the present invention. As illustrated, the upright vacuum cleaner 10 includes a main housing incorporating a nozzle assembly 14 and a canister assembly 16. The canister assembly 16 is pivotally mounted to the nozzle assembly 14. A foot latch 19 locks the canister assembly 16 in the upright position illustrated in FIGS. 1 and 2. Depressing the foot latch 19 releases the canister assembly 16 so that it pivots freely relative to the nozzle assembly 14 when the vacuum cleaner 10 is manipulated by an operator to clean a floor.

The canister assembly 16 includes a pair of rear wheels 18 and the nozzle assembly 14 includes a pair of front wheels 20. Together, the wheels 18, 20 allow the vacuum cleaner 10 to roll smoothly over the surface of the floor being cleaned as it is being manipulated by the operator. A height adjustment switch 22 allows the operator to adjust the position of the front wheels 20 relative to the body 24 of the nozzle assembly 14 so as to allow the cleaning height of the vacuum cleaner 10 to be adjusted to provide efficient and effective cleaning of substantially any foreseeable type of floor surface. The nozzle assembly 14 also includes an agitator cavity 26. The agitator cavity 26 receives a pair of agitators 28 that are mounted so as to rotate relative to the agitator body 26.

The canister assembly 16 includes a housing 30 having a cavity 32 for receiving the dirt cup 12 in a manner that will be described in greater detail below. Additionally, the canister housing 30 includes an internal compartment 34 for holding a suction generator 36 which may, for example, take the form of a fan and motor assembly. As is known in the art, the motor of the suction generator 36 may be connected to the agitators 28 by means of a power transmission (not shown) so that the agitators are rotated relative to the nozzle body 24 to brush and beat dirt and debris from the nap of an underlying carpet being cleaned.

The canister assembly 16 also includes a control handle 38 connected to the canister assembly 30. The control handle 38 carries a hand grip 40 and may also be equipped with an actuator switch 42 for turning the vacuum cleaner on and off. An electrical cord (not shown) connects the electrical system of the vacuum cleaner with a wall outlet.

Figure 3:
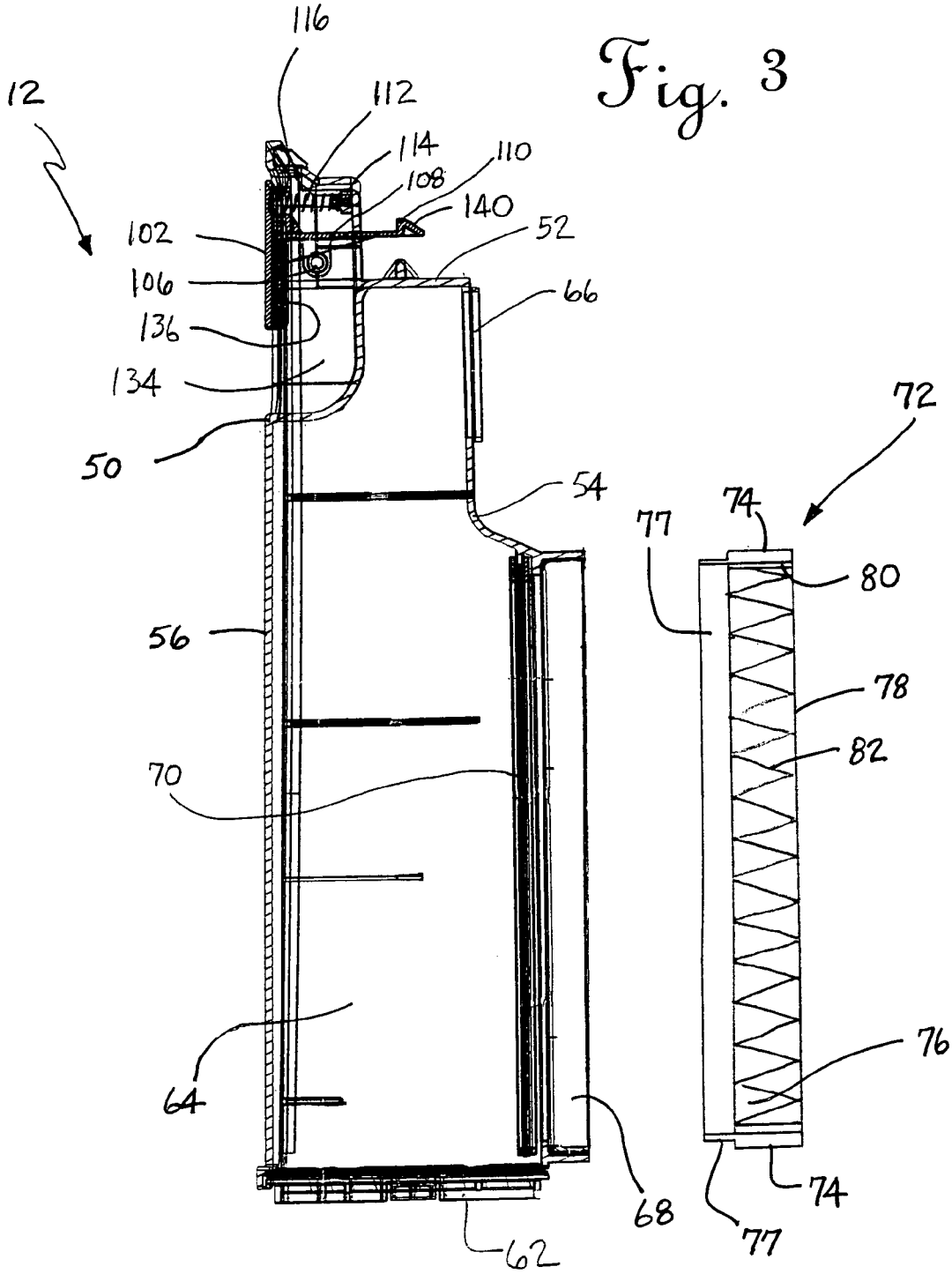
FIG. 3 is a detailed cross-sectional view of the dirt cup.
Figure 4:
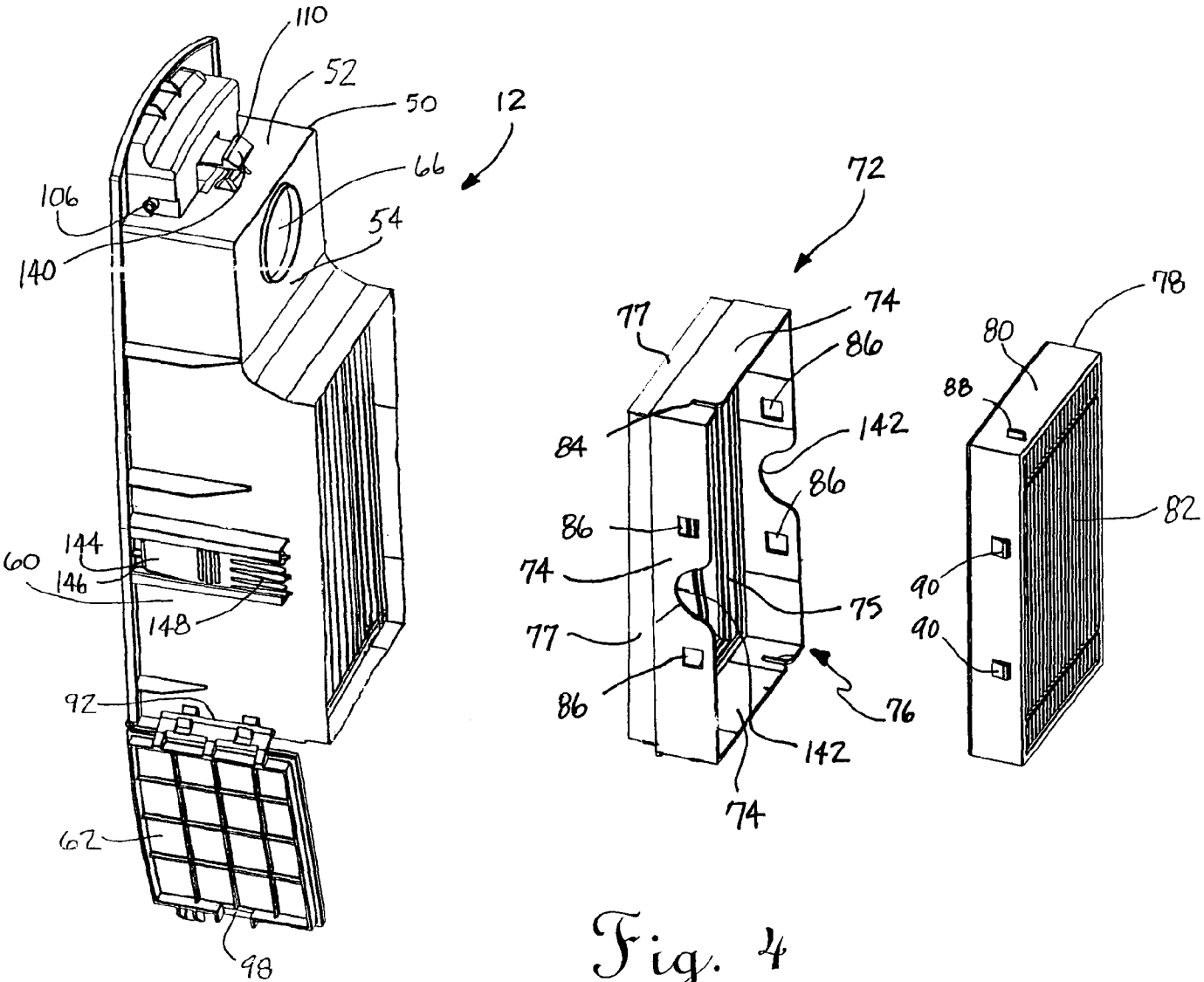
FIG. 4 is a partially exploded perspective view of the dirt cup with the bottom wall open to allow emptying of the dirt collection chamber.
Figure 5:
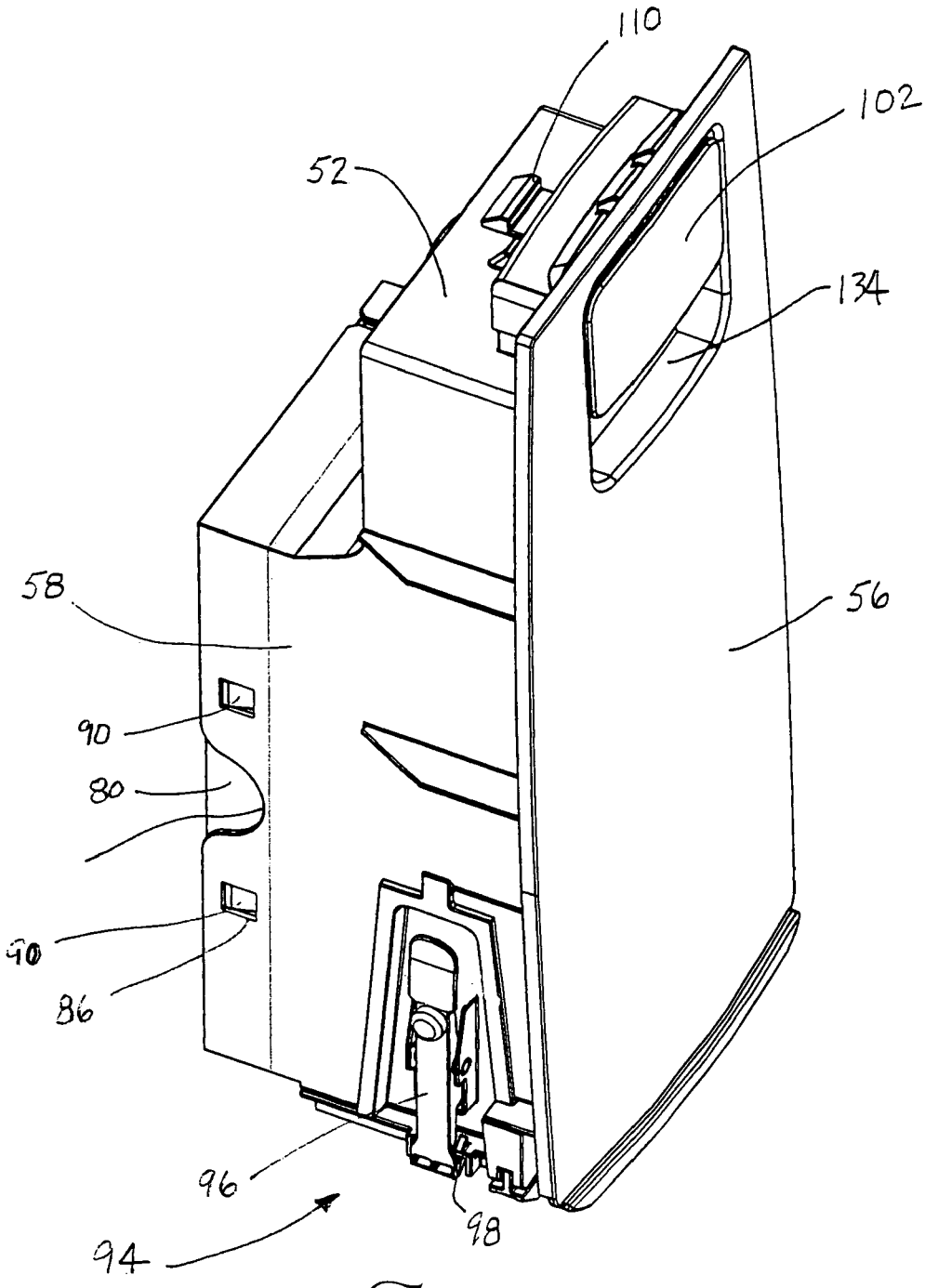
FIG. 5 is a perspective view showing the bottom wall latch of the dirt cup.

Reference is now made to FIGS. 3–5 showing the dirt cup 12 and the selectively attachable and detachable filter holder 72 in detail. As illustrated, the dirt cup 12 comprises a housing 50 including a top wall 52, four sidewalls 54, 56, 58, 60 and a bottom wall 62 that define a dirt collection chamber 64. An inlet 66 and an outlet 68 are provided in the sidewall 54 of the housing 50 and provide fluid communication with the dirt collection chamber 64. A prefilter 70, such as a screen, may be optionally mounted in the dirt cup 12 to extend fully across the outlet 68. The prefilter 70 may be made removable for easy cleaning.

A separate filter holder 72 is mounted on the sidewall 54 of the housing 50 external to the dirt collection chamber 64. Thus, as should be appreciated, the filter holder 72 is downstream from both the outlet 68 and the optional prefilter 70. As illustrated in FIGS. 3 and 4, the filter holder 72 includes a series of side walls 74 and a vented bottom wall 75 that define a cavity 76. A filter 78 is received in the cavity 76. As illustrated, the filter 78 may take the form of a filter cartridge including a support or frame 80 and a pleated filter media 82 of a type known in the art to be useful for the intended purpose. Cooperating guide notches 84 and slots 86 on the side walls 74 of the filter holder 72 match up with cooperating guide tabs 88 and latching lugs 90 on the support 80 to ensure that the filter 78 is properly seated in the cavity 76.

In the illustrated embodiment, the side walls 74 are stepped to provide a series of mounting flanges 77 sized to engage and provide a friction fit inside the outlet 68 of the dirt cup housing 50. Thus, the filter holder 72 may be tightly secured by a substantially airtight connection to the housing 50 of the dirt cup 12. While no locking ridges, tabs or other structures are illustrated, it should of course be appreciated that, if desired, any appropriate structure known to those skilled in the art may be utilized to secure the filter holder 72 to the dirt cup housing 50.

As further illustrated in FIGS. 3 and 4, the bottom wall 62 of the dirt cup 12 is connected by means of a hinge 92 to the sidewall 60 of the housing 50. Thus, the bottom wall 62 may be hinged open from the sidewalls 54, 56, 58 to allow dirt and debris to be emptied from the dirt collection chamber 64. A latch, generally designated by reference numeral 94, is carried on the sidewall 58 and includes a spring loaded lever arm 96 that is pivotally mounted to the dirt cup housing 50 (see FIG. 5). The lever arm 96 is equipped with a shoulder to engage the notched edge 98 of the bottom wall 62 to secure the bottom wall in the closed position, sealing the bottom of the dirt collection chamber 64.

A second latching mechanism 100 is provided on the side wall 56 of the dirt cup housing 50. As best illustrated in FIG. 3, the latching mechanism 100 includes an actuator 102 mounted by pivot pins 106 in apertures formed in the housing 50. The actuator 102 also includes a projecting latching element 108 having a latching tab 110. A spring 112 has a first end carried on a guide 114 on the housing 50 and a second end that engages in a cavity 116 on the actuator 102. This spring 112 biases the actuator 102 and, more particularly, the latching element 108 into the latching position. In the latching position the latching tab 110 engages the shoulder or edge 118 of the canister assembly 16 so that the dirt cup 12 is positively held in the cavity 32 (note FIG. 2).

At certain times, it may be desirable to clean the pleated filter media 82 in order to increase vacuum cleaner performance. Toward that end, a comb-like cleaning tool 144 is conveniently stored in a channel 146 provided on the sidewall 60 of the dirt cup 12. One removes the cleaning tool 144 by sliding it from the channel 146. The teeth 148 of the cleaning tool 144 are then combed over the pleated media to free dirt and debris. Following cleaning, the tool 144 is returned to the storage channel 146.

In operation, the vacuum cleaner operator manipulates the actuator switch 42 to energize the motor of the suction generator 36. As previously discussed, the motor of the suction generator 36 also drives the agitators 28 through a transmission such as a gear drive, a belt drive or a combined belt and gear drive. As the vacuum cleaner 10 is manipulated back and forth across the floor by the operator, the rotating agitators 28 brush and beat dirt and debris from the nap of an underlying carpet or rug being cleaned. That dirt and debris becomes entrained in the suction airstream drawn into the vacuum cleaner 10 by the suction generator 36. Thus, air entrained with dirt and debris passes from the nozzle cavity 32 through the intake port 120 and a hose and conduit system 122 into the inlet port 124 provided in the rear of the canister housing 30 (note the hoses connecting the port 120 to the conduit 122 and that conduit to the inlet port 124 are not shown). The air entrained with dirt and debris then passes into the dirt collection chamber 64 of the dirt cup through the inlet 66 (see action arrow A in FIG. 2). The prefilter 70 ensures that the larger particles of dirt and debris are collected in the dirt collection chamber 64.

The suction airstream, now devoid of the relatively large particles of dirt and debris passes freely from the dirt collection chamber 64 through the prefilter 70 and is then drawn through the filter 78. The pleated filter media 82 of the filter 78 cleans the remaining fine particles of dirt and debris from the airstream. The now clean air is then drawn from the filter cavity 76 into the suction conduit 126 formed in the rear of the canister housing 30 (see action arrows B in FIG. 2). The air is then drawn through the opening 128 into the internal compartment 34 housing the suction generator 36. A supplemental filter may be provided across the opening 128 if desired. The air then passes over the motor of the suction generator 36 to provide cooling before being exhausted through a final filter (not shown) and the exhaust port 132 into the environment (see action arrow C in FIG. 2).

At some point, dirt and debris will fill the dirt collection chamber 64 and it will become necessary to empty the dirt cup 12. In order to achieve this end, the operator reaches one or more fingers into the cavity 134 in the sidewall 56 and engages the inner face 136 of the actuator 102. The operator then pivots the actuator in the direction of action arrow A about the pivot pins 106 thereby freeing the latching tab 110 from the shoulder/edge 118 of the canister housing 30. The dirt cup 12 is then easily removed from the cavity 32 of the canister housing 30.

The dirt cup 12 may then be carried to a garbage can, garbage bag or other garbage collection vessel where it may be emptied. This is done by positioning the dirt cup over the vessel and manipulating the latch 94 so that the lever arm 96 swings free of the notched edge 98 of the bottom wall 62. The bottom wall 62 then opens under the force of a biasing spring (not shown) swinging about the hinge 92. Dirt and debris then fall from the dirt collection chamber 64 into the garbage can, bag or vessel. Following emptying, the bottom wall 62 is pivoted closed about the hinge 92 until the lever arm 96 again engages the notched edge 98 thereof.

The dirt cup 12 is then repositioned in the cavity 32 in the canister housing 30. When properly seated, the inlet 66 seats against a seal to provide airtight fluid communication with the inlet port 124 and the filter holder 72 seats against a seal to provide airtight fluid communication with the suction conduit 126. Simultaneously the latching tab 110 slips past the shoulder 118 through cooperation of the cam surfaces 138 and 140 and engages the shoulder to secure the dirt cup 12 in the cavity 32.

In summary, numerous benefits result from employing the concepts of the present invention. The dirt cup 12 is of relatively simple construction and is inexpensive to produce. It also provides excellent cleaning efficiency and is user friendly. The dirt cup 12 may be easily emptied by simply opening the hinged bottom wall 62. Since there is no filter or any other structure in the dirt collection chamber 64 of the dirt cup 12 to interfere with emptying, dirt and debris flows freely from the dirt cup when the bottom wall 62 is opened.

In addition, the filter 78 may be easily changed. Notches 142 are provided in the side walls 74 of the filter holder 72 so that the support 80 may be easily gripped to slide the filter 78 from the cavity 76. A new filter 78 may then be dropped into place by aligning the guide tabs 88 with the guide notches 84 and engaging the lugs 90 with the slots 86. If desired, the entire filter holder 72 may be removed from the dirt cup 12 by simply pulling the flanges 77 out of the outlet 68. This allows the operator to take the filter holder 72 to the store to be fitted with a new filter 78. This is certainly more convenient than taking the entire vacuum cleaner 10 or the entire dirt cup 12. Further, the filter holder 72 may be quickly cleaned in the sink with running water and, therefore, is much more sanitary to handle than the used filter.

The foregoing description of the preferred embodiment of this invention has been presented for purposes of illustration and description. It is not intended to be exhaustive or to limit the invention to the precise form disclosed. Obvious modifications or variations are possible in light of the above teachings. While the dirt cup and external filter holder of the present invention is illustrated in use in an upright vacuum cleaner, it should be appreciated that the dirt cup may also be utilized in a hand-held or a canister vacuum cleaner if desired. Further, while the agitators 28 of the upright vacuum cleaner are described as being driven by the motor of the suction generator 36, it should be appreciated that a separate agitator drive motor could be provided if desired. A single agitator or more than two agitators could also be used.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed:

1. In a vacuum cleaner including a main housing, the improvement comprising a dirt cup including:

a dirt cup housing for removably attaching to the main housing and defining a dirt collection chamber, said housing including a first sidewall;

an inlet in said first sidewall of said housing in fluid communication with said dirt collection chamber;

an outlet in said first sidewall of said housing in fluid communication with said dirt collection chamber; and an attachable and detachable filter holder on said dirt cup housing external to said dirt collection chamber and downstream from said outlet.

2. The dirt cup of claim 1 further including a prefilter held on said dirt cup housing across said outlet.

3. The dirt cup of claim 2, further including a filter in said filter holder.

4. The dirt cup of claim 3, wherein said filter includes a support and a pleated filter media.

5. The dirt cup of claim 4, wherein said prefilter is a screen.

6. The dirt cup of claim 4, wherein said dirt cup housing includes a top wall and a bottom wall.

7. The dirt cup of claim 6, wherein said bottom wall is connected by a hinge to a second sidewall.

8. The dirt cup of claim 7, further including a first latch carried on said dirt cup housing and securing said bottom wall in a closed position.

9. The dirt cup of claim 7 further including a second latch carried on said dirt cup housing and securing said dirt cup to a vacuum cleaner.

10. The dirt cup of claim 1, further including a filter in said attachable and detachable filter holder.

11. The dirt cup of claim 10, wherein said filter includes a support and a pleated filter media.

12. The dirt cup of claim 11, further including a prefilter held on said dirt cup housing, wherein said prefilter is a screen.

13. The dirt cup of claim 11, wherein said dirt cup housing includes a top wall and a bottom wall.

14. The dirt cup of claim 13, wherein said bottom wall is connected by a hinge to a second sidewall.

15. The dirt cup of claim 14, further including a first latch carried on said dirt cup housing and securing said bottom wall in a closed position.

16. The dirt cup of claim 14 further including a second latch carried on said dirt cup housing and securing said dirt cup to a canister assembly forming part of the main housing of the vacuum cleaner.

17. A vacuum cleaner, comprising:

a nozzle assembly;

a canister assembly;

a suction generator carried on one of said nozzle assembly and said canister assembly; and a dirt cup carried on one of said nozzle assembly and said canister assembly;

said dirt cup being characterized by a housing defining a dirt collection chamber, said housing including a first sidewall;

an inlet in said first sidewall of said housing in fluid communication with said dirt collection chamber;

an outlet in said first sidewall of said housing in fluid communication with said dirt collection chamber;

an attachable and detachable filter holder on said housing external to said dirt collection chamber and downstream from said outlet.

18. The vacuum cleaner of claim 17, wherein the dirt cup is carried on the canister assembly.

* * * * *